US010077900B2

(12) United States Patent
Lynch

(10) Patent No.: US 10,077,900 B2
(45) **Date of Patent: *Sep. 18, 2018**

(54) CANDLE HOLDER WITH INTERNAL CHAMBER

(71) Applicant: Lindsay Lynch, Casselberry, FL (US)

(72) Inventor: Lindsay Lynch, Casselberry, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/468,184

(22) Filed: Mar. 24, 2017

(65) Prior Publication Data

US 2017/0191654 A1 Jul. 6, 2017

Related U.S. Application Data

(63) Continuation-in-part of application No. 14/618,553, filed on Feb. 10, 2015, now Pat. No. 9,625,144.

(51) Int. Cl.

| | |
|---|---|
| ***F21V 35/00*** | (2006.01) |
| ***F23D 3/16*** | (2006.01) |
| ***F21V 23/04*** | (2006.01) |
| ***F21S 9/02*** | (2006.01) |
| *H04R 1/02* | (2006.01) |
| *F21Y 115/10* | (2016.01) |

(52) U.S. Cl.

CPC ..... *F23D 3/16* (2013.01); *F21S 9/02* (2013.01); *F21V 23/04* (2013.01); *F21V 35/00* (2013.01); *F21Y 2115/10* (2016.08); *H04R 1/028* (2013.01)

(58) Field of Classification Search

CPC ..... F21V 35/00; F21S 10/023

USPC ..... 431/291, 288, 298; 27/1, 35; 52/128, 52/134

See application file for complete search history.

(56) References Cited

U.S. PATENT DOCUMENTS

| | | | |
|---|---|---|---|
| 5,683,239 | A | 11/1997 | Cardosi |
| 5,813,098 | A | 9/1998 | Schneider |
| 6,023,822 | A | 2/2000 | Luebke |
| 6,161,268 | A | 12/2000 | Joseph |
| 6,520,606 | B1 | 2/2003 | Robinson |
| 6,785,939 | B1 | 9/2004 | James |
| 6,904,721 | B1 | 6/2005 | Forbes |
| 7,036,195 | B2 | 5/2006 | Glass |
| 7,174,611 | B1 | 2/2007 | Rose et al. |
| 7,178,209 | B1 | 2/2007 | Radziewicz |
| 7,562,423 | B2 | 7/2009 | Pryd-Kakuk |
| 7,987,564 | B2 | 8/2011 | Leeder |
| 8,046,881 | B2 | 11/2011 | Johnson et al. |
| 8,146,216 | B2 | 4/2012 | Creager |
| 8,627,555 | B2 | 1/2014 | Kennedy |
| 2006/0179623 | A1 | 8/2006 | Robinson |
| 2010/0043187 | A1 | 2/2010 | Steuer |
| 2014/0047683 | A1 | 2/2014 | Cook et al. |
| 2015/0013123 | A1 | 1/2015 | Lynch |

*Primary Examiner* — Gregory Huson
*Assistant Examiner* — Nikhil Mashruwala
(74) *Attorney, Agent, or Firm* — Jason T. Daniel, Esq.; Daniel Law Offices, P.A.

(57) ABSTRACT

A candle holder with internal chamber includes a generally hollow main body having a candle holder along the top end, and a storage vessel positioned within the main body. The storage vessel including an opening that is removably connected to a cap. The main body is constructed from a translucent material, and the cap includes a plurality of lights, an audio unit for playing music, a lock for securing the cap onto the vessel, and an air evacuation unit for removing air from the inside of the storage vessel.

13 Claims, 5 Drawing Sheets

CANDLE HOLDER WITH INTERNAL CHAMBER

CROSS-REFERENCE TO RELATED APPLICATIONS

This application is a continuation-in-part of, and claims the benefit to copending U.S. application Ser. No. 14/618,553 filed on Feb. 10, 2015, the contents of which are incorporated herein by reference.

TECHNICAL FIELD

The present invention relates generally to decorative candle holders, and more particularly to a candle holder having an internal chamber.

BACKGROUND

The statements in this section merely provide background information related to the present disclosure and may not constitute prior art.

Decorative items such as pictures and artwork are used in home and office settings to allow a resident to showcase his or her likes and interests. In many cases, these settings also have one or more candles which allow for a more intimate atmosphere. Conversely, there are certain items that a resident would prefer to keep out of view by visitors.

Accordingly, it would be beneficial to provide a decorative candle holder with an internal chamber that is capable of performing each of the above noted functions.

SUMMARY OF THE INVENTION

The present invention is directed to a candle holder with an internal storage vessel. One embodiment of the present invention can include a generally hollow main body having a fireproof candle holder along a top end thereof. A removable cap can engage the storage vessel for allowing a user to secure items within the vessel, and any number of commemorative and decorative items can be secured along the main body.

In one embodiment, a plurality of lights can be disposed along the removable cap for illuminating the interior space of the main body. In such an embodiment, the main body can be constructed from a translucent material, and both the storage vessel and candleholder can be constructed from a generally transparent material so as to be illuminated by the plurality of lights.

In another embodiment, the removable cap can include an audio unit for playing music, a lock for securing the cap onto the vessel, and an air evacuation unit for removing air from the inside of the storage vessel.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
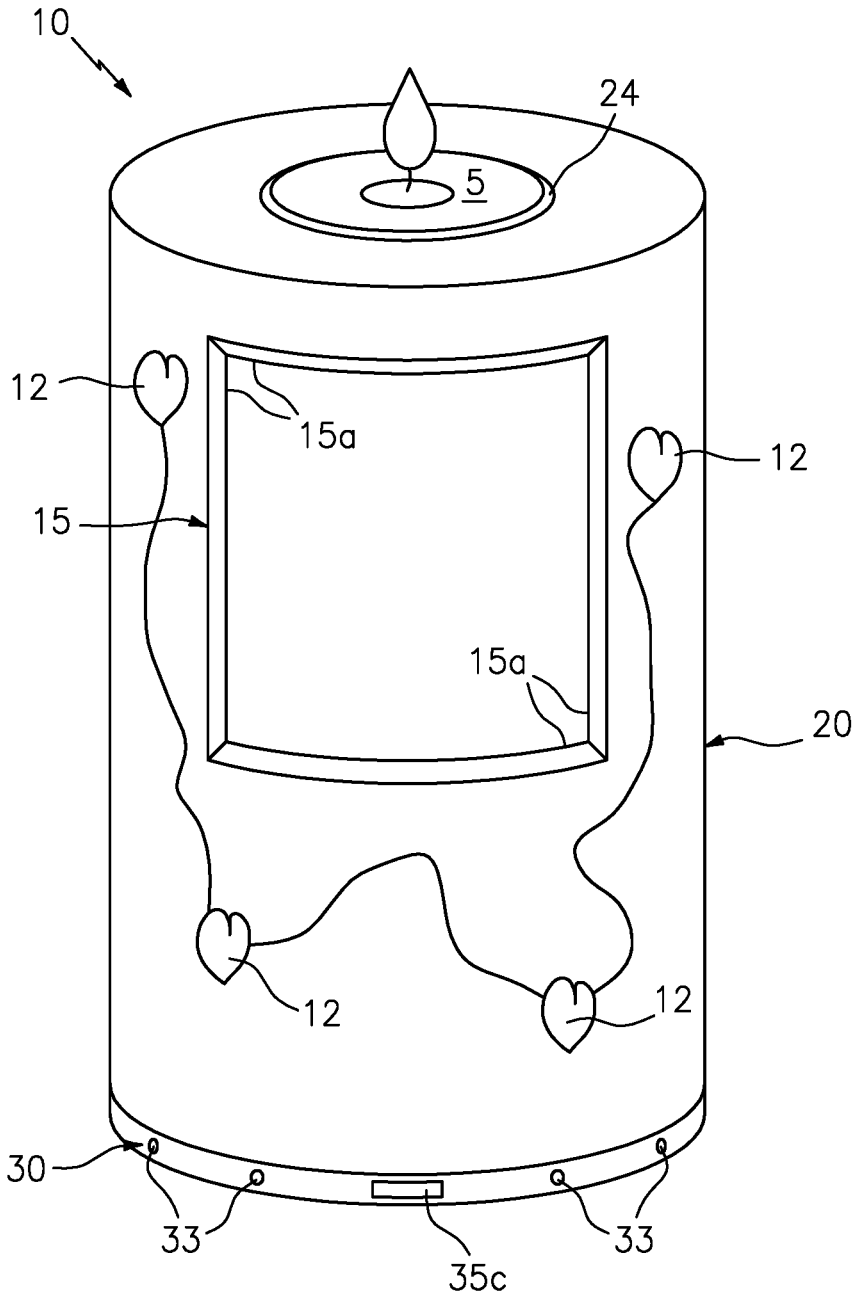
FIG. 1 is a perspective view of a candle holder device, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "removably secured" and derivatives thereof shall be used to describe a situation wherein two or more objects are joined together in a non-permanent manner so as to allow the same objects to be repeatedly joined and separated. This can be accomplished through the use of different shaped items that fit together and are held in place by gravity, and/or through the use of any number of commercially available connectors such as opposing strips of hook and loop material (i.e. Velcro®), magnetic elements, and compression fittings such as hooks, snaps and buttons, for example. Moreover, the term "permanently secured" shall be used to describe a situation wherein two or more objects are joined together in a manner so as to prevent the same objects from being separated. Several nonlimiting examples include various adhesives such as glue or resin, hardware such as nuts and bolts, and welds, for example.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIGS. 1 illustrates one embodiment of the candle holder device 10 that is useful for understanding the inventive concepts disclosed herein. As will be described below, the device 10 can include a main body 20, having an internal storage vessel 25, a candleholder 24, and a removable cap 30.

The main body 20 can include an elongated, generally hollow member having a top end 21*a*, a middle section 21*b* and an open bottom end 21*c* that define a generally hollow interior space 22. An opening 23 can be disposed along the top end 21*a* of the device and can extend into the hollow interior space 22.

As described herein, the main body 20 can include any number of different shapes and sizes, and can preferably be constructed from a single piece of translucent plastic which can interact with the below described illumination device, so as to allow the main body to glow when the device is turned on. Of course, the main body may be formed from any number of other materials that are, for example, relatively strong and stiff for their weight. For example, the main body may also be formed from a metal or metal alloy (e.g., aluminum, steel, titanium, or alloys thereof), other plastic/polymers (e.g., high-density polyethylene (HDPE) or polyethylene terephthalate (PET)), or any number of composite materials (e.g., carbon fibers in a polymer matrix, fiberglass, etc.).

The main body can further include a number of decorative elements 12 such as paper wrapping, faux jewels, plaques, and other such items having any number of different colors, markings, words, shapes, symbols, logos, designs, texturing of materials, and/or patterns. These decorative elements can be inlaid onto the main body 20 or can be raised/protruding outward from the main body 20, so as to give a three dimensional effect. In addition to the above, the decorative element(s) can also include texturing of the main body itself.

In various embodiments, the main body can also include one or more commemorative item holders 15, such as a picture frame having a plurality of raised or recessed lip/edge sections 15*a* that can function to receive and engage the edges of a commemorative item such as a photograph, painting, drawing, document, or other such item. In the preferred embodiment, each of the lip/edge sections can preferably be constructed from a substantially identical material as the main body 20, however any number of other suitable materials are also contemplated.

Figure 2:
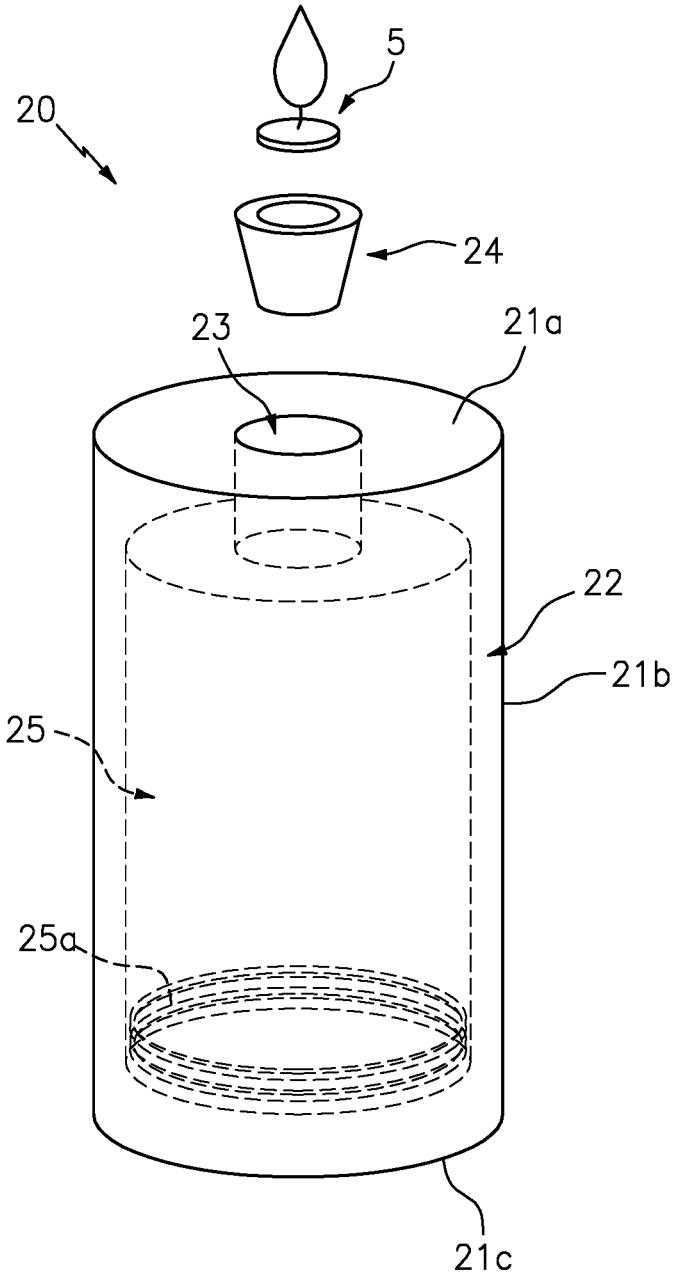
FIG. 2 is a perspective view of the main body of the candle holder device, in accordance with one embodiment of the invention.
Figure 3A:
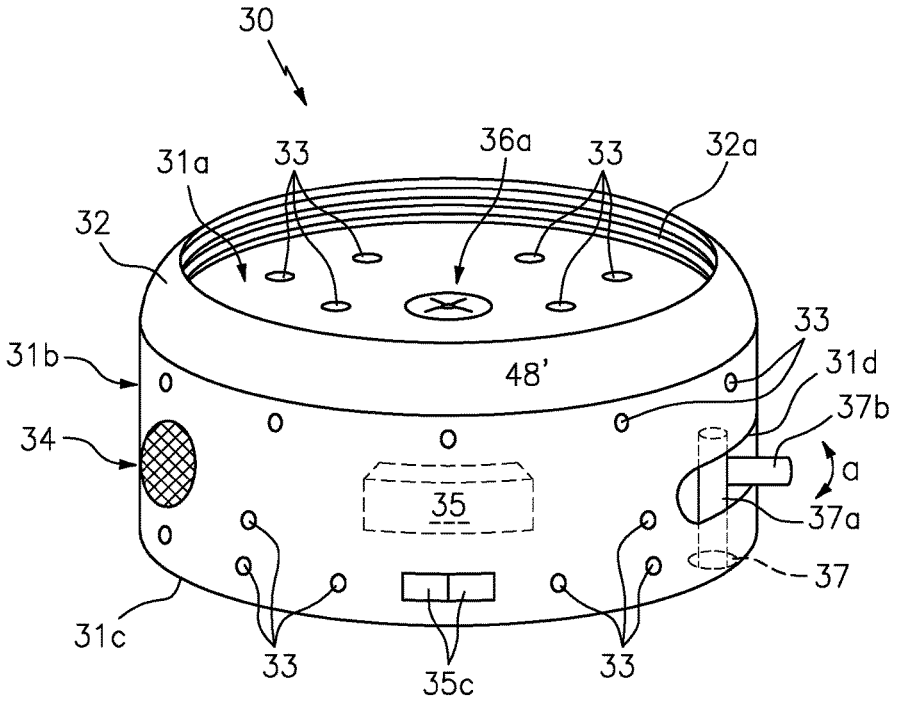
FIG. 3A is a perspective view of the removable cap of the candle holder device, in accordance with one embodiment of the invention.
Figure 3D:
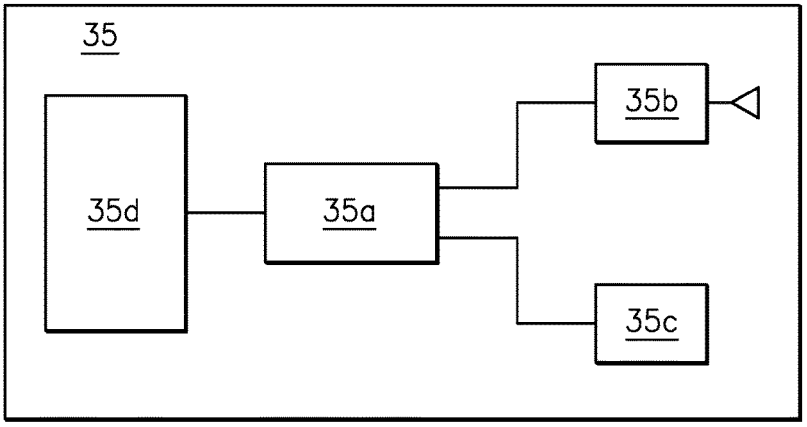
FIG. 3D is a simplistic block diagram of the audiovisual controller of the candle holder device, in accordance with one embodiment of the invention.
Figure 3C:
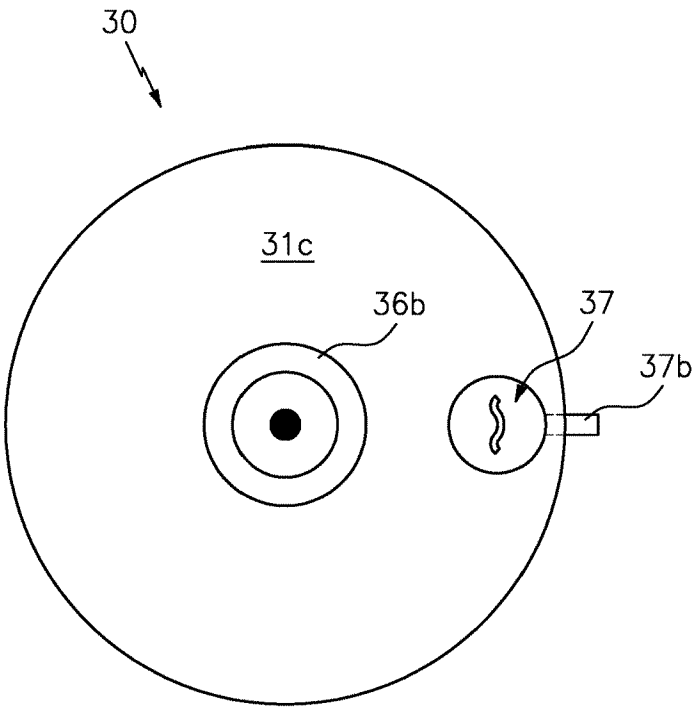
FIG. 3C is a bottom view of the removable cap of the candle holder device, in accordance with one embodiment of the invention.
Figure 3B:
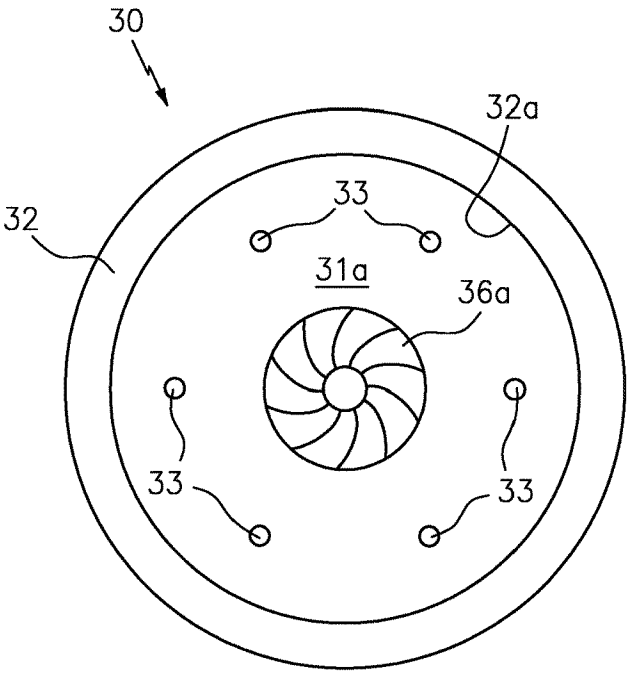
FIG. 3B is a top view of the removable cap of the candle holder device, in accordance with one embodiment of the invention.

As shown best in FIG. 2, a candle holder 24 can be permanently or removably positioned within the opening 23, and can function to receive any number of different candles 5. In the preferred embodiment, the candle holder 24 will be constructed from a fire resistant material such as glass or metal, for example. In this regard, by positioning a separate fire resistant holder 24 between the main body 20 and the vessel 25, the device 10 advantageously functions to direct any heat produced from the candle away from the device 10. Moreover, the combination of a standard removable wax candle 5 and a fireproof candleholder 24 can be particularly beneficial in instances where a user forgets to extinguish a candle before leaving the device unattended. To this end, the candleholder 24 can continue to direct heat away from the device until the candle self-extinguishes, thereby preventing damage to the device and/or the surrounding environment.

A storage vessel 25 can be positioned within the hollow interior space of the main body 22, and can include a threaded opening 25*a* for receiving the below described cap 30. In the preferred embodiment, the vessel 25 can include or comprise a clear glass jar, such as a mason jar, for example, that creates a waterproof and airtight chamber for storing any number of different items.

By providing a clear vessel, the light that is generated by the below described cap is not diminished by the presence of the vessel. Such a feature advantageously allows light generated by the cap to pass through the vessel and to illuminate the entire outer portion of the main body. Of course, other embodiments are contemplated wherein the vessel is constructed from any number of other materials, such as those described above with regard to the main body, for example.

FIGS. 3A-3D, illustrate one embodiment of the removable cap 30. As shown, the cap can include a cap body 31, a plurality of lights 33, an audio unit 34, an audiovisual controller 35, an air evacuation unit 36 and a lock 37.

The cap body 31 can include any number of different shapes, sizes and construction materials such as those described above with regard to the main body 20. In the preferred embodiment, the cap body can include a generally cylindrical-shaped member having an upper end 31*a*, a middle body section 31*b* and a bottom end 31*c*. The main body also including a raised section 32 having a threaded edge 32*a* for engaging the threaded opening 25*a* of the vessel via a twisting motion. Although other dimensions are contemplated, it is preferred that the cap body include dimensions suitable for allowing a majority (e.g., 80-90%) of the cap body to be positioned inside the hollow interior space of the main body along the bottom end of the same.

In the preferred embodiment, each of the lights 33 can include or comprise light-emitting-diodes (LED), capable of generating light in any number of different colors and intensities. Each of the lights can be positioned along any portion of the cap body 31 and can be connected to the below described controller. The lights can also include functionality for performing any number of lighting effects such as to flash, change color, or perform a chasing pattern based on an instruction from controller.

As described herein, the audio unit 34 can include a commercially available radio and/or MP3 player, for example, having an integrated speaker and that is capable of storing, receiving and/or playing any number of audible sounds. Digital media players such as an MP3 player are extremely well known in the art, and can be connected to the controller 35.

The audiovisual controller 35 can function to provide power to, and control an operation of the audio visual components 33 and 34. As shown best in FIG. 3D, the controller can include a processing unit 35*a*, a wireless communication unit 35*b*, one or more control switches 35*c*, and/or a power source 35*d*.

The processing unit 35*a* can include a central processing unit (CPU), a timer, and memory that are capable of controlling the operation of the device. As described herein, the timer can be provided as a function of the processor or can include a separate physical circuit. In either instance, processors, timers and various types of memory (e.g., persistent and non-persistent), are extremely well known in the art, therefore no further description will be provided.

The wireless communication unit 35*b* can include any number of components capable of sending and/or receiving electronic signals with an externally located device. In the preferred embodiment, the unit can include an infrared transceiver and/or a Bluetooth transceiver, for example, that are capable of communicating wirelessly with an external device such as a remote operation unit and/or a smartphone running an App, respectively.

Any number of control switches 35*c* can be provided along the cap body, and can function to switch the electronic components of the device between an ON and OFF state, initiate a Sleep mode, initiate the timer, and/or to pair the wireless communication unit with an external device, and so on.

The power source 35*d* can include any number of different components capable of providing the necessary power requirements to each element of the system. In the preferred embodiment, the power source can include or comprise one or more batteries that are removably positioned within the cap body 31 and accessible via a battery compartment (not illustrated). Of course, other embodiments are contemplated wherein the power source includes an a/c electrical power transformer and cord capable of allowing the system to be powered from an electrical outlet.

The air evacuation unit 36 can function to allow a user to remove air from the storage vessel when the cap 30 is secured thereon. In one embodiment, the unit can include a one way valve having an air inlet section 36*a* positioned along the top surface of the cap body 31*a*, and an air outlet section 36*b* positioned along the bottom surface of the cap body 31*c*. The valve can be engaged by a pump (not illustrated) to allow a user to remove air within the vessel. Such a feature is particularly beneficial, as it allows users to store smoking material such as tobacco, for example, that becomes stale when exposed to the air. Air evacuation units are well known in the art. One commercially available example that is incorporated by reference includes the wine saver system that is commercially available from VacuVin®.

Figure 4:
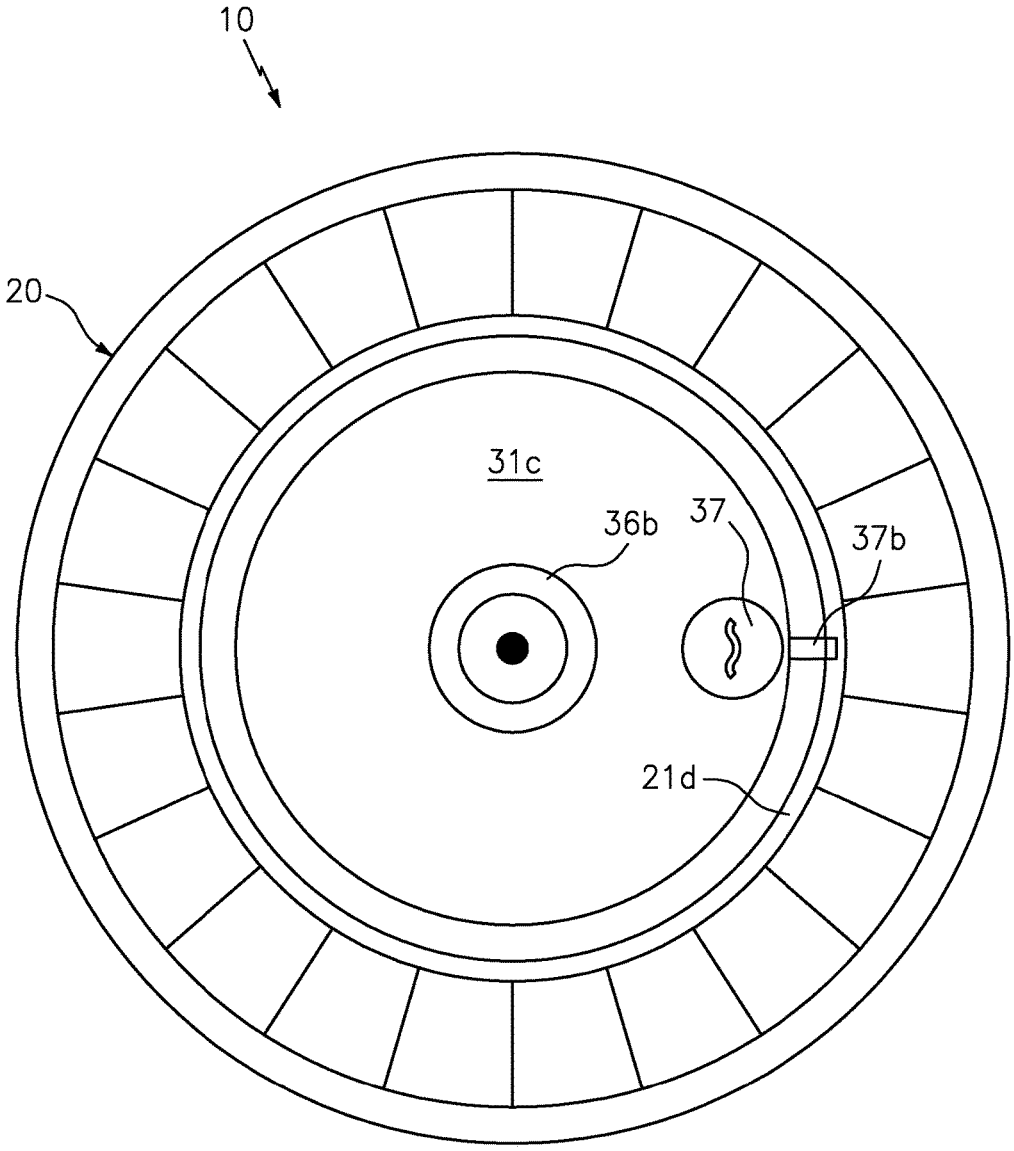
FIG. 4 is a bottom view of the candle holder device, in accordance with one embodiment of the invention.

The lock 37 can function to prevent an unauthorized user from removing the illuminated cap 30. In one embodiment, the lock can include a conventional key-operated cam lock having a lock housing 37*a* that selectively transitions a cam shaft 37*b* through an opening 31*d* in the cap body (see arrow a). When the cap 30 is secured onto the vessel 25 as described above, and the lock is in the extended position, the distal end of the cam shaft 37*b* can be positioned within a channel/groove 21*d* of the main body, as shown in FIG. 4. When so positioned, the shaft 37*b* prevents removal of the cap until the same is retracted back into the cap body.

In operation, a user can store and lock any number of different items within the storage vessel and can utilize the air evacuation unit to remove air from the same. Moreover, the lights of the cap can function to illuminate the main body for any desirable time as determined by the timer, the audio unit can play any desirable music for any amount of time determined by the timer, and a candle can be safely positioned along the top of the main body. Moreover, when no candle is positioned within the candle holder, the light generated by the lights 33 can extend upward through the candle holder, thus giving the effect of candle light.

As described herein, one or more elements of the candle holder with internal chamber 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that any number of different individual elements may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A candle holder device, comprising:

a main body having an elongated, generally hollow interior space and an open bottom end;

a candle holder opening that is disposed along a top end of the main body, said opening being in communication with the hollow interior space;

a storage vessel that is disposed within the hollow interior space, said vessel having including an opening that is positioned along a bottom end thereof; and a cap that is removably secured to the opening of the storage vessel, wherein the cap and storage vessel form an airtight and waterproof chamber when secured together.

2. The device of claim 1, further comprising:

a generally fire resistant candle holder that is configured to be positioned within the candle holder opening, said candle holder including a shape that is conducive for receiving a candle and to direct any heat produced from the candle away from the main body.

3. The device of claim 1, further comprising:

a picture frame that is disposed along an outside surface of the main body.

4. The device of claim 1, further comprising:

a lock that is positioned along the removable cap, said lock being configured to secure the cap onto the main body when in a locked positon.

5. The device of claim 1, further comprising:

an air evacuation unit that is secured along the cap, said unit being configured to remove air that is located within the storage vessel.

6. The device of claim 1, further comprising:

a plurality of lights that are secured along the removable cap, said lights being configured to illuminate the hollow interior space of the main body.

7. The device of claim 6, wherein the main body is constructed from a translucent material that is configured to be illuminated by the plurality of lights.

8. The device of claim 7, wherein the storage vessel is constructed from a generally transparent material that is configured to be illuminated by the plurality of lights.

9. The device of claim 8, further comprising:

a generally fire resistant candle holder that is positioned within the candle holder opening of the main body, said candle holder being constructed from a transparent material that is configured to be illuminated by the plurality of lights.

10. The device of claim 6, further comprising:

an audio unit that is positioned within the removable cap.

11. The device of claim 10, further comprising:

a timer that is in communication with each of the plurality of lights and the audio unit, said timer functioning to selectively activate the same upon receiving a user command.

12. The device of claim 10, further comprising:

a wireless communication unit that is positioned within the removable cap, said unit functioning to communicate with an external device to control an operation of each of the plurality of lights and the audio unit.

13. The device of claim 12, further comprising:

a power unit that is positioned within the removable cap, said power unit functioning to supply power to each of the wireless communication unit, the audio unit and the plurality of lights.

* * * * *